United States Patent [19]

Weis

[11] 4,311,281

[45] Jan. 19, 1982

[54] COMMINUTOR INSTALLATION

[75] Inventor: Frank G. Weis, Kansas City, Mo.

[73] Assignee: Ecodyne Corporation, Lincolnshire, Ill.

[21] Appl. No.: 82,718

[22] Filed: Oct. 9, 1979

[51] Int. Cl.[3] ..... B02C 18/06

[52] U.S. Cl. ..... 241/46 R; 210/174

[58] Field of Search ..... 210/67, 174; 241/46 R, 241/46.04, 46.06, 46.15

[56] References Cited

U.S. PATENT DOCUMENTS

| | | | |
|---|---|---|---|
| 281,511 | 7/1883 | Howland | 241/46.15 |
| 1,982,266 | 11/1934 | Nordell | 210/174 X |
| 2,342,927 | 2/1944 | Durdin, Jr. | 210/174 X |
| 2,380,025 | 7/1945 | Chase | 241/46 R X |

*Primary Examiner*—Mark Rosenbaum

*Attorney, Agent, or Firm*—Hume, Clement, Brinks, Willian & Olds, Ltd.

[57] ABSTRACT

The invention relates to a rotary drum comminutor installation which includes a rectilinearly-shaped chamber with the comminutor eccentrically positioned therein.

7 Claims, 5 Drawing Figures

COMMINUTOR INSTALLATION

BACKGROUND OF THE INVENTION

This invention relates to an improved rotary drum comminutor installation.

A comminutor is a device designed to cut or break up large solids present in a fluid stream without having to remove the solids from the liquid. Comminutors are typically employed in waste treatment plants where they can improve efficiency and lower operation and maintenance costs. In smaller treatment plants, comminution can significantly improve efficiency by reducing the size of incoming solids and allowing more complete biological reduction of organic materials. In larger treatment systems, comminution can significantly improve performance of downstream equipment. Comminution can also reduce clogging of pipes and small pumps, such as foam control systems, reducing maintenance and labor costs.

A rotary drum comminutor is a type of comminutor having a generally cylindrical slotted drum which is rotatively driven about an upright axis and in which the fluid travels axially downward through the comminutor after it passes through the slots in the drum.

In a typical rotary drum comminutor installation, the comminutor is mounted in a spiral-shaped concrete chamber, with the base of the comminutor being depressed below the level of the incoming sewage. Sewage is delivered to the inlet end of the chamber and is distributed around the cylindrical drum of the comminutor by the spiral-shaped flow passage. When the fluid reaches the comminutor, the liquid and very small solid particles pass through the drum slots into the hollow interior, down through the bottom of the drum, through an inverted siphon formed in the base of the concrete chamber, and into the downstream effluent channel. Solids that are too large to pass through the drum slots are held against the drum by the pressure of the flow and are carried by the rotation of the drum to stationary combs. Cutting teeth attached to the drum cut the solids held against the combs into particles small enough to pass through the drum slots. The spiral flow of the liquid in the spiral-shaped chamber returns any partially cut solids to the drum to repeat the cutting process until the particles are sufficiently small to pass through the drum slots.

One of the major drawbacks of rotary drum comminutors, particularly in large comminutor sizes, is the complicated concrete chamber required to create the spiral-shaped passage surrounding the comminutor. Special concrete forms are required to pour this chamber, which usually must be shipped to the installation site by the comminutor manufacturer, and additional time, materials and expense are required for site preparation and fabrication of the chamber. In addition, rotary drum comminutors normally have bases which cause substantial fluid head loss. Loss of head is an important factor in the cost of construction and operation of a sewage treatment facility and is a significant drawback to the use of rotary drum comminutors. While some of this head loss can be corrected by construction of concrete return bends and other design features, such features increase the cost and complication of the installation. Moreover, the aforementioned design features of a normal rotary drum comminutor require a concrete chamber bottom of considerable structural strength. The concrete thickness required to achieve this strength creates an additional head loss and adds to the cost of construction and operation of the comminutor installation.

SUMMARY OF THE INVENTION

This invention relates to an improved rotary drum comminutor installation in which the spiral-shaped flow passage and concrete chamber used heretofore are replaced by a rectangular or otherwise rectilinear-shaped chamber and the comminutor is eccentrically positioned within the resulting longitudinal flow channel to create a flow pattern around the drum which is similar to the type flow pattern produced by a spiral-shaped channel.

Advantageously, the side walls of the comminutor chamber are formed by the side walls of the longitudinal flow channel which delivers sewage to the comminutor. While the rear wall of the rectilinear comminutor chamber may be made of concrete, it advantageously comprises a removable partition or plate which extends across the flow channel just downstream from the comminutor. Preferably, this partition includes means for raising the partition to an elevated position so that the level of liquid in the comminutor chamber can be adjusted if needed.

In another advantageous aspect of the present invention, the comminutor is provided with a thin metal base plate which doubles as the bottom of the comminuting chamber. This plate is advantageously supported by ridges provided on the side walls of the comminutor chamber and by a depression in the floor of the longitudinal flow channel upstream from the comminutor, so that the thick concrete subfloor normally provided under the comminutor can be eliminated. This design also permits the inverted siphon connecting the communitor outlet to the effluent channel to be replaced by an easily formed, rectilinear-shaped receiving channel which delivers comminuted fluid to the effluent channel.

In addition, the installation of this invention may be provided with an adjustable submerged weir or shear gate located in the effluent channel which can be used to create a backpressure on the system to help control the fluid height outside the comminutor drum and the number of cutting teeth which are engaged at any one time in comminuting solids in the liquid.

One of the principal advantages of the present invention is the elimination of the spiral-shaped comminutor chamber heretofore used in rotary drum comminutor installations without a significant loss in operating efficiency. The use of a simple, rectilinear-shaped comminutor chamber with no elaborate concrete subfloor, which can be used as a result of the flow pattern created by the eccentric placement of the comminutor, significantly reduces the cost and the time required to install a rotary comminutor system and makes rotary comminutor systems much more competitive with other types of comminutor systems.

Another principal advantage of the present invention is the substantial reduction in fluid head loss and operating costs which can be achieved. The elimination of the spiral-shaped walls in the center of the flow channel and the use of a metal base plate eliminates the need for a thick sub-floor across the flow channel and its accompanying head loss. The metal base plate also eliminates the necessity of lowering the floor of the comminutor chamber to allow for the height of a conventional base, which avoids the head loss associated with this feature of the prior art installations.

Additional features and advantages of this invention are described in, and will appear from, the description of the preferred embodiments which follow and the drawings, to which reference is now made.

DESCRIPTION OF THE PREFERRED EMBODIMENTS

Figure 1:
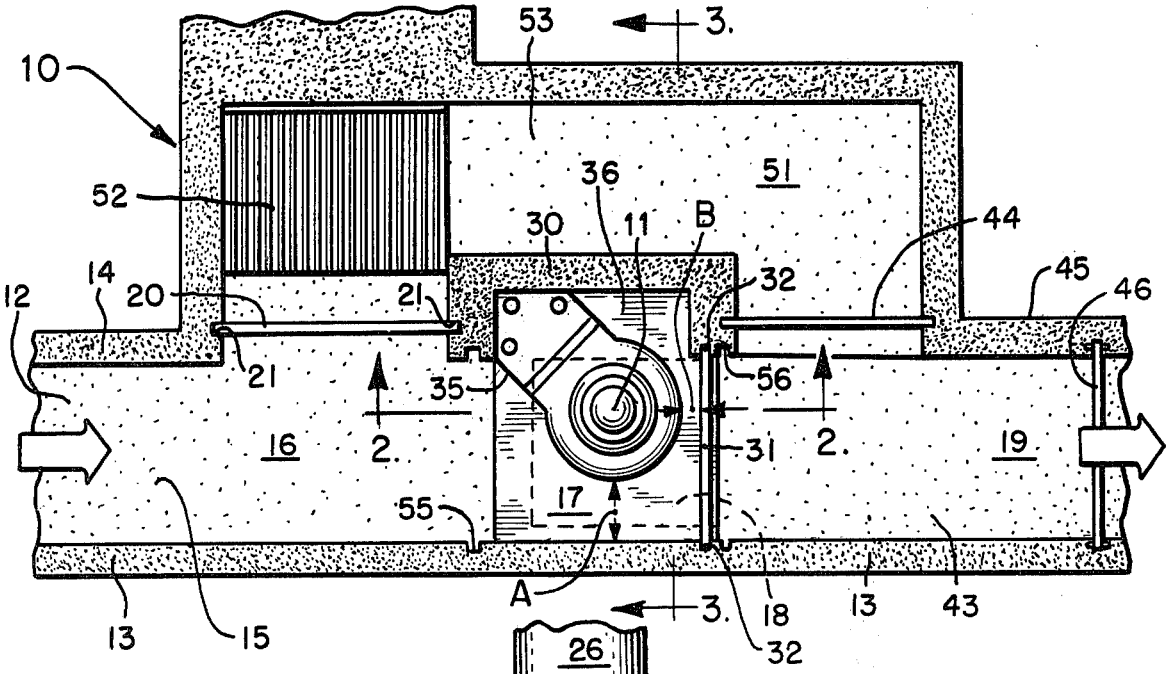
FIG. 1 is a plan view of an embodiment of the rotary drum comminutor installation of the present invention.

Referring to FIG. 1, reference numeral 10 generally indicates a concrete structure defining the flow system in which the rotary drum comminutor 11 is installed. Incoming sewage enters the comminutor system through inlet flow channel 12 which is defined by concrete side walls 13 and 14 and concrete floor 15. After passing through inlet channel 12, the sewage is normally directed toward the communitor 11 by a longitudinal flow channel 16 which leads to comminutor chamber 17. Sewage passing through communitor 11 leaves comminutor chamber 17 through receiving channel 18 (see FIG. 2) which is connected to sewage effluent flow channel 19 which delivers the sewage to the next treatment step.

Longitudinal flow channel 16 which delivers sewage to comminutor chamber is defined by extensions of side wall 13 and floor 15 and by a by-pass stop gate 20 (the function of which is described below) mounted in guide slots 21 in the concrete structure.

Figure 2:
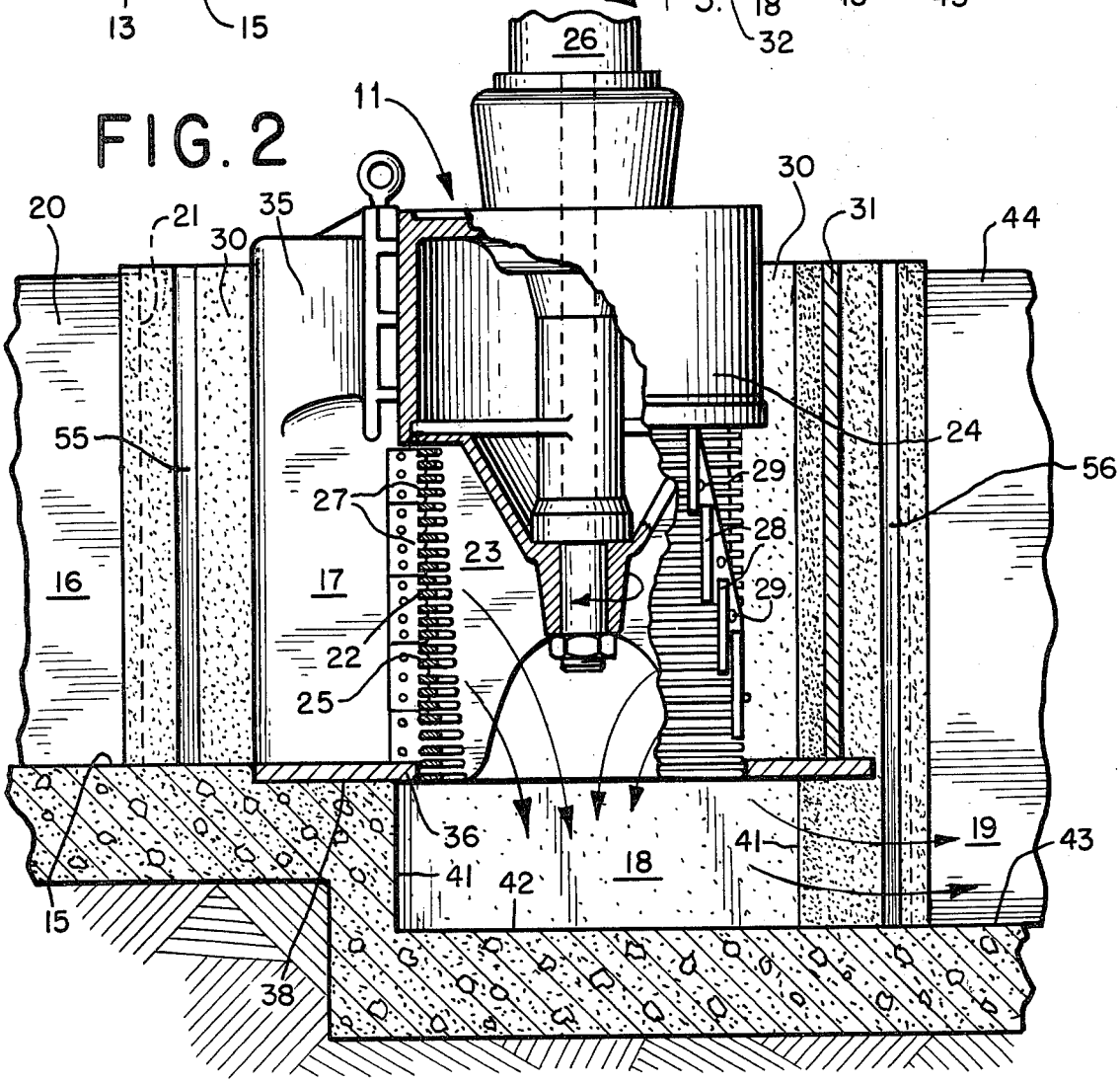
FIG. 2 is a vertical sectional view of the rectangular-shaped comminutor chamber employed in the embodiment of FIG. 1, taken along line 2—2 in FIG. 1.

The rotary drum comminutors which may be employed in the installation of this invention are available from a number of commercial sources. As shown by FIG. 2, comminutors of this type are formed by a housing 24 on which a cylindrical slotted drum 25 is mounted. This drum is rotatively driven about its upright axis by motor 26 mounted on top of housing 24. The slots 22 in the drum are designed to permit liquid and very small solid particles to pass through the drum and into the generally hollow interior 23 of the communitor which is in flow communication with receiving channel 18. Stationary combs 27 are mounted on the housing 24 and the rotating drum 25 is provided with cutter bars 28 and cutting teeth 29 to break up large solid materials into particles small enough to pass through the slots. These large solid materials are held against the outside of the moving drum by the flow of liquid through the drum and are carried by the drum to the stationary combs 27. When a cutting tooth 29 passes through a comb 27, it cuts small particles from the solid. Solids that are pushed partially through the drum slots are also carried to the stationary combs 27 by the moving drum, where they are cut off between the faces of the comb 27 and a cutter bar 28.

Comminutor chamber 17 is generally rectangular-shaped in plan. In the embodiment shown in FIG. 1, it is formed by concrete side walls 13 and 30 and partition 31. Partition 31, which is advantageously made of metal, is movably mounted in guide slots 32 in walls 13 and 30 so that it closes off flow channel 16 downstream from comminutor 11 and defines the rear wall of comminutor chamber 17.

Comminutor 11 is eccentrically positioned in chamber 17 so that drum 25 is offset from the center of the chamber. The housing 24 is provided with a vertical column 35 which abuts against a corner of side wall 30 of chamber 17 to close off a portion of the chamber to prevent sewage from flowing completely around the comminutor. Preferably, the comminutor is positioned so that open flow channel A between the comminutor drum and side wall 13 is $\frac{1}{2}$ to 1 times the diameter of the comminutor drum and the distance between the comminutor drum and the rear wall or partition 31 of the chamber is $\frac{1}{4}$ to $\frac{1}{2}$ the diameter of the comminutor drum.

This offsetting of the comminutor drum in a rectangular comminutor chamber tends to create the same type of flow pattern produced by the complicated spiral-shaped chambers used heretofore. This new arrangement tends to produce a spiral flow of sewage around the drum. It reduces the apparent surface area of the drum as the sewage flows around the drum from the inlet to the blocked corner. It also tends to keep the velocity relatively constant so that solids do not settle out, and it tends to return any partially cut solids to the drum to repeat the cutting process until the solid particles are sufficiently small to pass through the drum slots.

Figure 3:
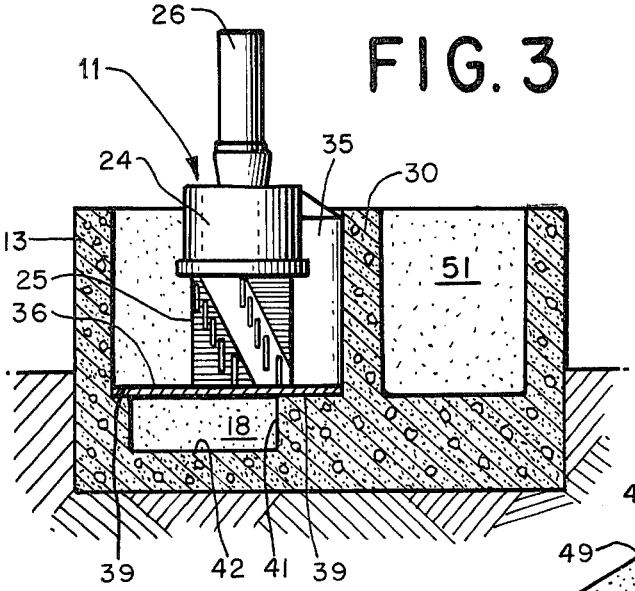
FIG. 3 is a vertical sectional view taken along line 3—3 in FIG. 1 which shows the placement of the base plate on a ridge formed along the side wall of the comminutor chamber.

Referring now to FIGS. 2 and 3, the comminutor 11 is mounted on a metal base plate 36 which is relatively thin, about $\frac{1}{2}''$ to $2''$ in thickness, depending on the size and weight of the comminutor. Base plate 36 is positioned over receiving channel 18 to prevent sewage from by-passing the comminutor. Advantageously, the base plate 36 is mounted in a depression 38 in concrete floor 15 and on ridges 39 along the inside edges of side walls 13 and 30, so that the top of the base plate is at the same elevation as floor 15 and can be used as the floor of the comminuting chamber.

After the sewage passes through the comminutor drum 25, it flows vertically downward into receiving channel 18. Receiving channel 18, like the other parts of the system, is formed by a series of simple, easy to install, concrete walls 41 and a flat concrete floor 42. Receiving channel 18 is in flow communication with effluent channel 19 to which the receiving channel delivers the sewage. Effluent channel 19 is formed by floor 43, side wall 13, and a side wall comprising by-pass stop gate 44 and wall 45. Advantageously, floor 42 of effluent channel 19 has the same elevation as floor 43 of receiving channel 18, although this arrangement is not essential.

Because the inverted siphon and the thick concrete subfloor used heretofore are not needed in the comminutor installation of this invention, it is possible to design the system for improved comminution at the system's normal design flow rate. This can be accomplished by selecting the distance between the floor 38 of the comminutor chamber and floor 42 of the receiving channel so that a restriction is formed to create a back-pressure on the comminutor which raises the height of fluid inside the drum and in the comminutor chamber. This causes the use of more drum slots. It also reduces fluid velocity through the slots which improves comminution due to improved cutting action.

Figure 4:
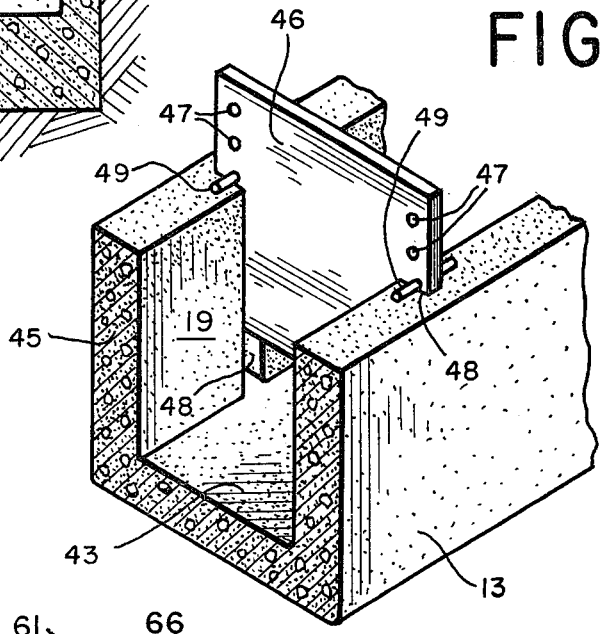
FIG. 4 is a perspective view of an adjustable submerged weir which may be used in connection with the installation of the present invention.

This improved comminution may also be obtained through the use of a downstream weir, such as shear gate 46 located in effluent channel 19. As shown in FIG. 4, this shear gate is provided with a series of holes 47 along each side of the gate where it fits into guide slots 48. Through the use of pins 49, gate 41 can be raised and lowered with respect to channel floor 43 to help create the appropriate backpressure needed to maintain the desired fluid height in the comminutor drum and in the comminutor chamber.

A similar set of holes may be provided in partition 31 so that it can be raised above the comminutor chamber floor in the event additional backhead control is needed or there is a need to allow some of the sewage to by-pass the comminutor.

The installation illustrated in FIG. 1 also is provided with a by-pass system, generally indicated by reference numeral 51, which can be used when the comminutor is shut down for maintenance. This by-pass system includes a bar screen 52 which traps large solid materials but permits liquid and small solids to pass through to by-pass channel 53 which is connected to effluent channel 19. When the by-pass system is needed, stop gates 20 and 44 are removed from their guide slots to open up the by-pass system and stop gates are inserted in guide slots 55 and 56 to isolate comminutor chamber 17 and receiving channel 18. Advantageously, partition 31 can be used as one of the isolating stop gates by removing it from its guide slots 32 and inserting it in guide slots 55 or 56.

Figure 5:
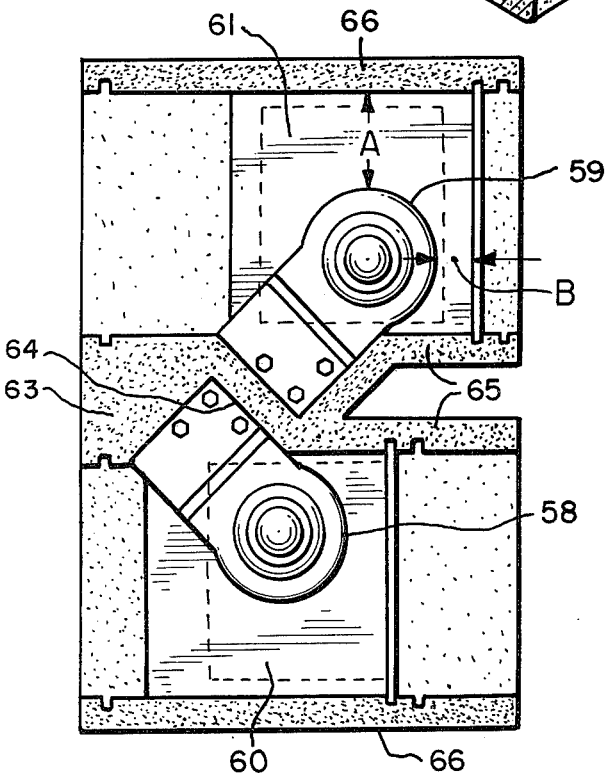
FIG. 5 is a plan view of an alternative embodiment of the rotary drum comminutor installation of the present invention.

FIG. 5 illustrates an alternative embodiment of the invention in which two comminutors 58 and 59 are installed in parallel so that a comminutor is always available to handle incoming sewage, even when one of the comminutors is shut down for maintenance. The principal differences between this embodiment and the previous one are the shape of the comminutor chambers 60 and 61 and the positioning of the comminutors, both of which are related to the design of side wall 63 of the comminutor chambers. As is apparent from the drawing, wall 63 has a first portion 64 which conforms to the shape of the column section of the comminutor and a second portion 65, parallel to opposite side wall 66, which is positioned close to the drum and reduces the size of the chamber away from the incoming sewage flow. This arrangement places the center of the comminutor drum somewhat more offset from the center of the chamber than in the previous embodiment. The other features of this embodiment of the invention correspond to features present in the previously described embodiment and will, therefore, not be described again.

The embodiments described herein are intended to be exemplary of the types of rotary drum comminutor installations which fall within the scope of this invention. However, there are many modifications and variations from these preferred embodiments which those skilled in the art would be expected to make without departing from the spirit or scope of the invention as described above and defined in the following claims.

I claim:

1. A comminutor installation comprising:

a rectilinear-shaped comminutor chamber;

an inlet channel in flow communication with the comminutor chamber;

a rotary drum comminutor located in the chamber having the center of its drum offset with respect to the geometric center of the chamber;

a receiving channel positioned under the comminutor to receive fluid passing vertically through the interior of the comminutor; and an effluent channel in flow communication with the receiving channel.

2. The comminutor installation of claim 1, wherein the comminutor chamber haas a rear wall and the distance between the comminutor drum and the rear wall of the chamber is $\frac{1}{4}$ to $\frac{1}{2}$ the diameter of the comminutor drum and the width of the flow channel between the communitor drum and a side wall of the chamber is $\frac{1}{2}$ to 1 times the diameter of the comminutor drum.

3. The comminutor installation of claim 1, wherein the rear wall of the comminutor chamber is metal or plastic.

4. The comminutor installation of claim 1, wherein the comminutor is fastened to a metal base plate set in a depression in the floor of the comminutor chamber.

5. The comminutor installation of claim 4, wherein the floor of the comminutor chamber is at the same elevation as the floor of the inlet channel.

6. The comminutor installation of claim 1, wherein the comminutor chamber is rectangular-shaped.

7. The comminutor installation of claim 1, wherein the comminutor chamber is square-shaped.

* * * * *